US006957645B1

(12) United States Patent
Cross

(10) Patent No.: US 6,957,645 B1
(45) Date of Patent: Oct. 25, 2005

(54) PLAY ENHANCEMENT SYSTEM FOR A PNEUMATIC PROJECTILE LAUNCHER AND METHOD FOR ENHANCING PLAY

(75) Inventor: Johnathan David Cross, Knoxville, TN (US)

(73) Assignee: Wade Shields, Knoxville, TN (US), part interest ( * ) Notice: Subject to any disclaimer, the term of this patent is extended or adjusted under 35 U.S.C. 154(b) by 0 days.

(21) Appl. No.: 10/761,764

(22) Filed: Jan. 21, 2004

(51) Int. Cl.[7] ..... F41B 11/02
(52) U.S. Cl. ..... 124/51.1
(58) Field of Search ..... 124/48, 49, 51.1; 318/139

(56) References Cited

U.S. PATENT DOCUMENTS 4,297,590 A * 10/1981 Vail ..... 307/43
4,360,766 A * 11/1982 Bogardus, Jr. ..... 318/139
4,788,480 A * 11/1988 Field et al. ..... 318/442
5,097,184 A * 3/1992 Echtler et al. ..... 318/139
5,341,075 A * 8/1994 Cocconi ..... 318/139
5,500,579 A * 3/1996 Kim et al. ..... 318/493
5,703,447 A * 12/1997 Higuchi ..... 318/139
5,816,232 A * 10/1998 Bell ..... 124/51.1
5,947,100 A * 9/1999 Anderson ..... 124/45
6,213,110 B1 * 4/2001 Christopher et al. ..... 124/51.1
6,305,367 B1 * 10/2001 Kotsiopoulos et al. ..... 124/49
6,311,682 B1 11/2001 Rice et al.
6,415,781 B1 * 7/2002 Perrone ..... 124/51.1
6,481,432 B2 11/2002 Rushton et al.
6,502,567 B1 * 1/2003 Christopher et al. ..... 124/51.1
6,520,171 B2 2/2003 Reible
6,615,814 B1 9/2003 Rice et al.
2001/0045779 A1 * 11/2001 Lee et al. ..... 307/66
2002/0017287 A1 2/2002 Rice et al.
2002/0135233 A1 * 9/2002 Cratty ..... 307/64
2003/0154968 A1 8/2003 Rice et al.
2003/0192522 A1 10/2003 Taryoto

FOREIGN PATENT DOCUMENTS

WO WO 03/038367 A1 5/2003

* cited by examiner

*Primary Examiner*—John A. Ricci
(74) *Attorney, Agent, or Firm*—Luedeka, Neely & Graham PC

(57) ABSTRACT

A play enhancement system for a pneumatic projectile launcher. The play enhancement system includes a first power source and second power source for selective connection to a circuit board in a projectile hopper for the projectile launcher. At least one of the first and second power sources comprises a rechargeable power source. A switching device is connected to the first and second power sources, and to the circuit board for selectively connecting the first power source or second power source between a power source recharger and the circuit board. Continued play is provided by switching between the first and second power supplies when a predetermined low voltage is reached.

21 Claims, 5 Drawing Sheets

PLAY ENHANCEMENT SYSTEM FOR A PNEUMATIC PROJECTILE LAUNCHER AND METHOD FOR ENHANCING PLAY

FIELD OF THE INVENTION

The invention relates to sports and entertainment devices and in particular to play enhancement systems for devices such as pneumatic projectile launchers.

BACKGROUND

A popular sport involves pneumatic projectile launchers and opposing teams. Pneumatic projectile launchers are commonly referred to as paintball guns. In paintball game, two or more "military" teams try to capture one another's flags. Each player on a team carries a compressed gas-powered gun that shoots gelatin or plastic spherical capsules, referred to hereafter as paintballs, which contain a colored liquid. When a player is hit with a paintball from an adversary's gun, the paintball ruptures and leaves a colored "splat" on the hit player who is then "out" and must leave the game.

Over the past few years, improvements in guns and paintball feed systems have increased the sophistication of the game. For example, automatic and semiautomatic paintball guns—guns that sequentially fire individual paintballs as fast as the trigger can be repeatedly pulled—have become more prevalent. The high firing rate capability of semiautomatic paintball guns has increased the need for bulk loader devices for feeding paintballs into such guns so that play is not interrupted.

In order to continuously feed projectiles such as paintballs into the launcher, a paintball hopper feeder is provided. A paintball hopper feeder is normally adapted to internally store a relatively large quantity of paintballs (for example 50–200 paintballs) and has a bottom outlet opening through which the stored paintballs can be sequentially fed into the gun on demand from a feed tube on the hopper. High speed paintball feeding devices have motorized paintball delivery mechanisms within the hopper. Dry cell batteries, either groups of 1.5 volt batteries or 9 volt batteries are provided within the hopper to power the delivery devices.

One problem with currently available high speed storage and delivery devices for paintball guns is that the play time is limited by the battery life of the power cells used to power the delivery devices. A player is forced to discontinue firing the gun in order to change the batteries once the power cells reach an energy level insufficient to maintain a desirably high paintball delivery rate to the gun. Another disadvantage of currently available paintball delivery systems is that the delivery rate of paintballs is limited by the design of the paintball feed hopper. Another disadvantage is that a user must continuously purchase a large quantity of batteries to power the projectile launcher and hopper.

Accordingly, there continues to be a need for improvements to paintball feed hoppers that significantly enhance the play time and rate of delivery of paintballs to a paintball gun, particularly a semiautomatic or automatic paintball gun.

SUMMARY OF THE INVENTION

With regard to the above and other objects and advantages, the invention provides a play enhancement system for a pneumatic projectile launcher. The play enhancement system includes a first power source and second power source for selective connection to a circuit board in a projectile hopper for the projectile launcher. At least one of the first and second power sources comprises a rechargeable power source. A switching device is connected to the first and second power sources, and to the circuit board for selectively connecting the first power source or second power source between a power source recharger and the circuit board.

In another aspect, the invention provides a method for increasing play time and/or projectiles ejected per second. The method includes providing a play enhancement system for a pneumatic projectile launcher. The play enhancement system includes a first power source and second power source for selective connection to a circuit board in a projectile hopper for the projectile launcher. At least one of the first and second power sources comprises a rechargeable power source. A recharger for recharging at least one of the first or second power sources is also provided. A display device displays an output voltage to the circuit board from the first power source or the second power source. A switching device is connected to the first power source, the second power source, the recharger and the circuit board for selectively connecting the first power source or second power source to the recharger and to the circuit board. During initial play, the first power source is selected. When the display device indicates the first power source has reached a predetermined output voltage, the power source is switched from the first power source to the second power source.

In yet another aspect the invention provides a paintball launching system containing a motorized paintball hopper having an exit port, and a paintball launcher having an entry port for movement of paintballs from the hopper to the launcher. An improvement to the paintball launching system includes a play enhancement means for providing power to the motorized paintball hopper. The play enhancement means contains at least a first power source, and at least a second power source. At least one of the first and second power sources is a rechargeable power source. A control means is connected to the first and second power sources and the motorized paintball hopper for switching between the first power source and the second power source.

Advantages of the invention include the ability to continue playing once a first power source is depleted of sufficient energy to continue launching projectiles or launching projectiles at the desired rate. Rather than discontinuing play to insert new batteries in the projectile hopper, a readily switchable secondary power source is provided. Another advantage of the system is that one or more of the power sources is preferably rechargeable to reduce the need for purchasing batteries once the power of the power source is depleted. Still another advantage of the system is that the system is adaptable to automatic control of power source switching to provide significantly longer play without intervention by a user. A further advantage of the invention is that the play enhancement system may be located either on or adjacent to the projectile hopper or launcher or remote from these devices, such as on a belt of the user to provide increased play time between power source replacements or recharging.

BRIEF DESCRIPTION OF THE DRAWINGS

Further advantages of the invention will become apparent by reference to the detailed description of preferred embodiments when considered in conjunction with the following drawings illustrating one or more non-limiting aspects of the invention, wherein like reference characters designate like or similar elements throughout the several drawings as follows.

DETAILED DESCRIPTION OF THE PREFERRED EMBODIMENTS

Figure 1:
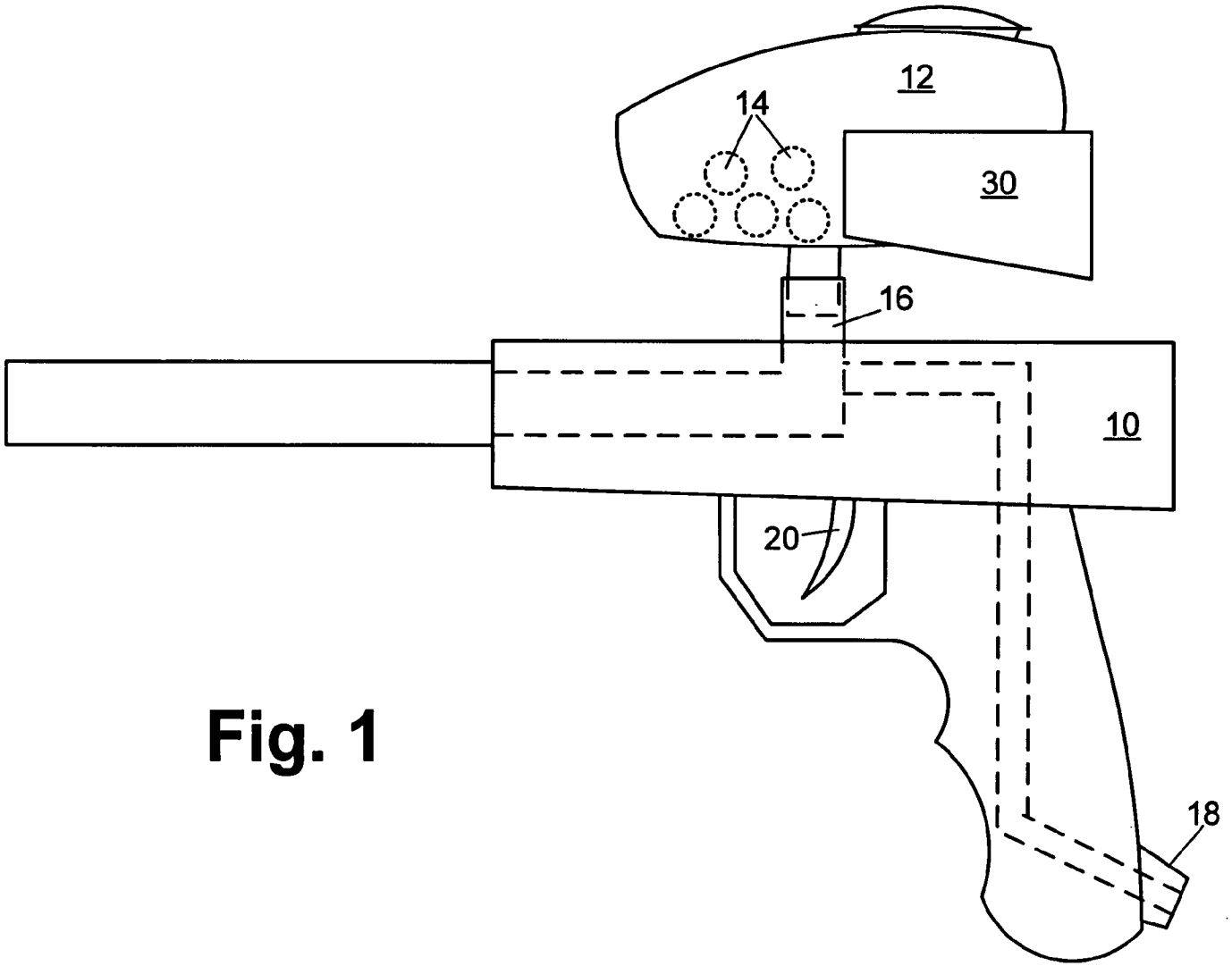
FIG. 1 is a plan view, not to scale, of a projectile launcher and projectile hopper system.

With reference to FIG. 1, there is provided a projectile launcher 10 having a projectile hopper 12 attached thereto for feeding projectiles 14 into the projectile launcher 10. The projectile launcher 10 is preferably a paintball gun having a paintball inlet port 16 for feeding paintballs 14 into the launcher 10. A gas port 18 is provided on one end of the launcher 10 for providing compressed gas to the launcher 10. Upon activation of a trigger mechanism, a paintball 14 loaded into the launcher 10 is launched at a high rate of speed toward a target.

As the launchers 10 become more sophisticated, more and more electronics are included in the launcher systems. Some of these improvements include automatic or semi-automatic launching of the paintballs as described, for example in U.S. Pat. No. 6,311,682 to Rice et al. With the advent of more sophisticated launchers 10, there is a need for increased paintball loading speeds. A wide variety of projectile hoppers 12 presently exist in the market. Particularly desirable projectile hoppers 12 include hoppers containing motorized conveying devices to feed paintballs 14 into the launcher 10 at a high rate of speed, i.e. from about 10 to about 15 balls per second. One such hopper 12 is described for example in U.S. Pat. No. 6,481,432 to Rushton et al.

Figure 2:
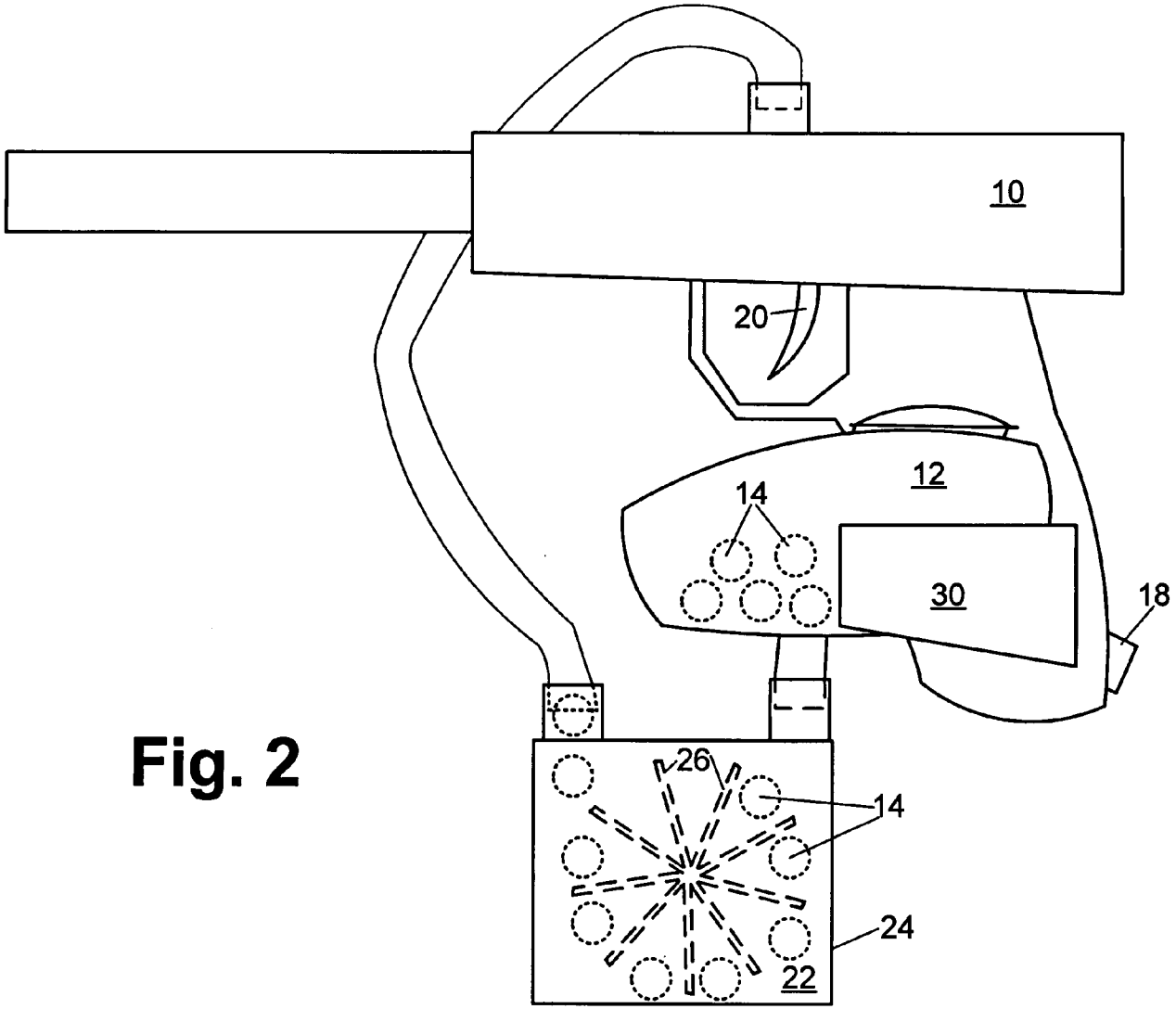
FIG. 2 is a plan view, not to scale, of an alternative arrangement of a projectile launcher and projectile hopper including a projectile booster system.

An alternative projectile feed system is illustrated in FIG. 2. In the system illustrated in FIG. 2, a feed booster 22 is provided. The feed booster 22 includes a housing 24 and a motorized conveyer 26 in the housing. As projectiles such as paint balls 14 are fed from the projectile hopper 12 into the projectile booster, the conveyor 26 propels the paintballs 14 at a high rate of speed through a connecting tube 28 into the projectile launcher 10. Like the projectile launcher 10 and projectile hopper 12 the feed booster 22 contains electronic components that enable the booster 22 to provide paintballs 14 on demand to the projectile launcher 10. An advantage of the feed booster is that paintballs 14 can be fed at a much faster rate to the projectile launcher 10 than with the projectile hopper 12 alone.

Figure 3:
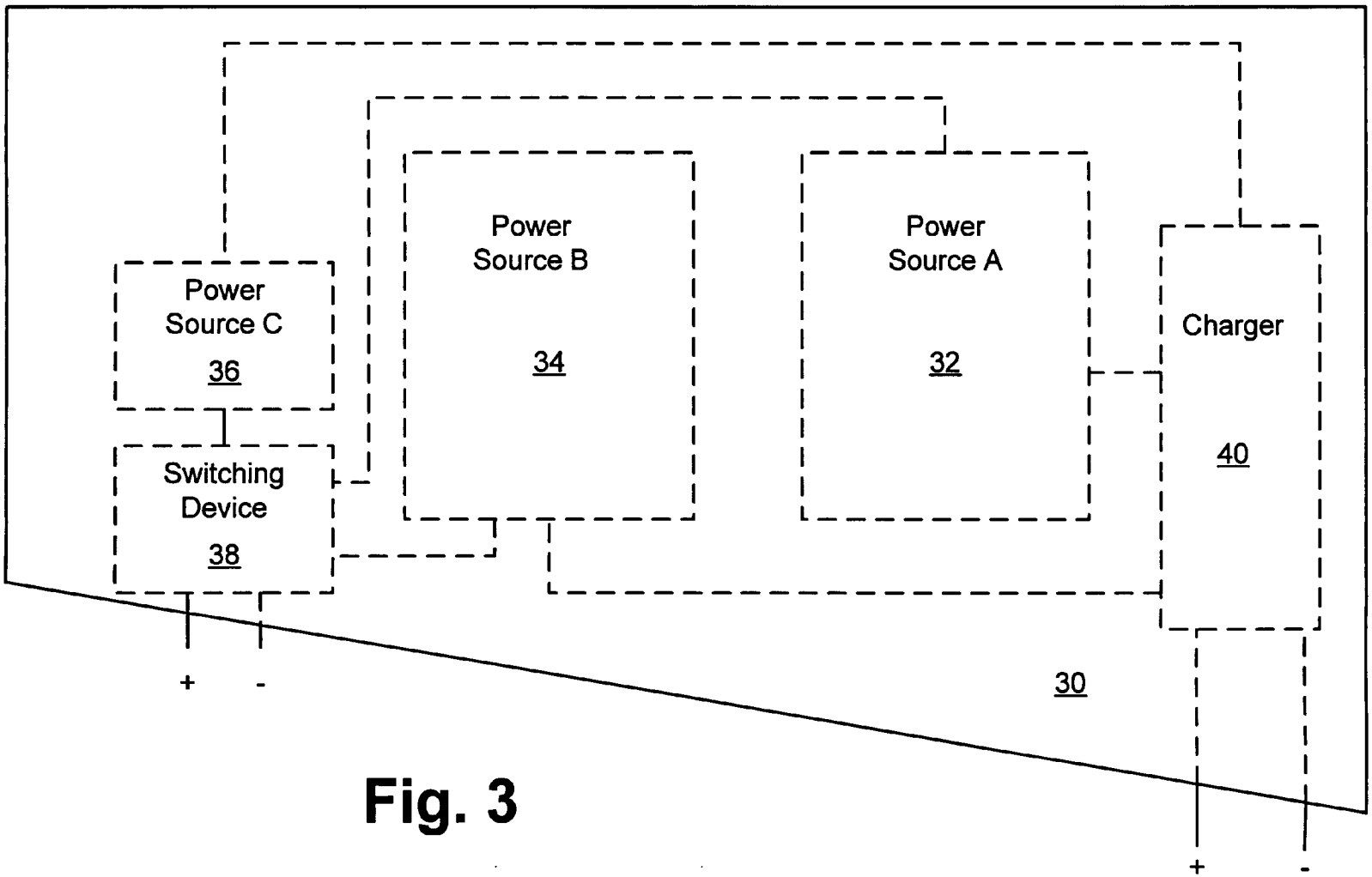
FIG. 3 is a schematic arrangement of a play enhancement system according to the invention.

In order to further enhance play over a prolonged period of time and to increase the projectile launch rate, a play enhancement system 30 as shown in FIG. 3 is preferably provided. The play enhancement system 30 preferably includes at least a first power source 32 and a second power source 34 (FIG. 3). The first power source 32 may be located in the play enhancement system or within the projectile hopper 12. The second power source 34 is preferably located in the play enhancement system. The first and second power sources 32 and 34 may be selected from non-rechargeable power sources and rechargeable power sources, provided that at least one of first power source 32 or the second power source 34 is a rechargeable power source.

It is particularly preferred that the first and second power sources be substantially the same. For example, AA batteries and AAA batteries have different characteristics, lifetimes, etc. If the first power source contains AA batteries, then the second power source 34 also preferably contains AA batteries. Likewise, it is preferred not to mix one type of battery with another type of battery. For example, an alkaline battery pack and a nickel metal hydride battery pack for the first and second power sources 32 and 34 should be avoided. Assembled battery packs containing 2 or more batteries per battery pack are preferably used as the power sources 32 and 34. The power source voltage for each power source 32 and 34 preferably ranges from about 3 volts DC to about 60 volts DC and should be compatible with the voltage required or useable by the projectile hopper 12. The invention however, does not preclude the replacement or modification of components in the projectile hopper 12 to increase the speed of the motor conveyor or ability of the circuit board to accept higher voltage inputs.

In another embodiment, the play enhancement system includes a third power source 36. The third power source 36 is preferably a power source having a lower voltage than the first and second power sources 32 and 34 and is used in combination with the first or second power sources 32 and 34 to increase the voltage to the projectile hopper 12 in order to increase delivery speed of the paintballs 14. As with the second power source 34, the third power source 36 is also preferably located in the play enhancement system 30. The voltage of the third power source 36 preferably ranges from about 1 to about 6 volts. The third power source 36 may be a non-rechargeable battery or battery pack or a rechargeable battery or battery pack. Like the first and second power sources 32 ad 34, the third power source 36 is also preferably composed of the same type of batteries or energy cells as the first and second power sources 32 and 34.

The play enhancement system 30 also preferably includes a switching device 38 for switching between the first power source 32 and the second power source 34, and for connecting the third power source 36 to the first or second power sources 32 or 34. The switching device 38 may be provided by toggle switches, relays, or an integrated circuit that can be programmed to automatically switch between the first and second power sources. A variable resistor or rheostat may be used to increase the voltage to the projectile hopper 12 using the third power source 36. In the alternative, an integrated circuit may be used to provide pre-set or settable power to the circuit board 42. As with the other components, the switching device 38 is also preferably provided in the play enhancement system 30.

The play enhancement system 30 may optionally include a battery charger 40 for recharging the first, second, or third power sources 32, 34, or 36. The battery charger 40 may be disposed in the play enhancement system 30 or may be remotely connected to the play enhancement system 30 to recharge the first, second, or third power sources 32, 34, or 36. The battery charger 40 may be plugged into a 110 voltage AC power source or be provided with a plug for insertion in a cigarette lighter or accessory outlet of an automobile for charging using a 12 volt DC power source. When the battery charger 40 is provided remote from the play enhancement system 30, a wiring connection or plug is provided on the play enhancement system for connecting the battery charger 40 to the play enhancement system 30. Some or all of the components of the play enhancement system 30 may be provided on a second circuit board in the play enhancement system 30.

The play enhancement system 30 is preferably attached to the projectile hopper 12 as shown in FIGS. 1 and 2. In the alternative, the play enhancement system 30, according to the invention may be worn by a user of the projectile launcher 10 during play or may be mounted on a separate mounting location adjacent to the projectile launcher 10 and projectile hopper 12.

Portions of the play enhancement system 30 may be located within the projectile hopper 12. For example, one of the first or second power sources 32 or 34 may be located within the projectile hopper 12. Also, when the play enhancement system 30 includes the third power source 36, it is preferred that a cooling devices, such as a cooling fan be included in the projectile hopper 12 to cool electronic components in the hopper 12 as described in more detail below. A fan or other forced draft device may also be provided in the play enhancement system 30 to vent the first, second, and/or third power sources 32, 34, and/or 36 during recharging thereof.

An important feature of the play enhancement device 30 is that it provides additional play time once an initial power source has been depleted. As shown by the following table, significantly increased projectile launches may be made with the play enhancement system 30 according to the invention. The foregoing table provides representative examples of available systems and the improvement expected by the foregoing system.

| Projectile Hopper System | Factory milliamp hours Energy Cells (MAH) | Play Enhancement System Total Energy Cells, (MAH) |
|---|---|---|
| ODYSSEY HALO Z with rip drive | 9 v. cell - 800 MAH or 6 - AA cells 13,200 MAH | 22 - AA cells - 16,280 MAH |
| ODYSSEY HALO TSA LED | 9 v. cell & 6 AA - 5,700 MAH or 6 - AA cells 13,200 MAH | 16 - AA cells - 11,840 MAH |
| ODYSSEY HALO A | 9 v. - 800 MAH or 6 AA cells - 13,200 MAH | 18 - AAA cells - 13,320 MAH |
| VIEWLOADER EVLUTION Y Board | 2 - 9 v. cells - 1,600 MAH | 19 AAA cells - 14,060 MAH |
| VIEWLOADER EVLUTION X Board | 2 - 9 v. cells - 1,600 MAH | 19 AAA cells - 14,060 MAH |
| VIEWLOADER REVUTION X | 2 - 9 v. cells - 1,600 MAH | 15 - AAA cells - 11,100 MAH |
| VIEWLOADER QUANTUM | 9 v. - 800 MAH | 10 - AAA cells - 7,400 MAH |
| VIEWLOADER REVUTION | 9 v. - 800 MAH | 11 - AAA cells - 8,140 MAH |
| RICOCHET AK | 9 v. - 800 MAH | 11 - AAA cells - 8,140 MAH |
| EMPIRE RELOADER | 9 v. - 800 MAH | 11 - AAA cells - 8,140 MAH |
| AIR GUN DESIGNS WARP FEED | 2 - 9 v. - 1,600 MAH | 22 - AAA cells - 16,280 MAH |

Another advantage of the invention, as described in more detail below is that the play enhancement device 30 preferably includes a voltage adjustment device to increase the speed of the motor in the projectile hopper 12 so that the hopper 12 can deliver more paintballs 14 per second during play. The following table illustrates the percentage increase in speed that the play enhancement system 30 is capable of delivering. These values are based on actual tests of some of the following systems with increased voltages to the circuit board 42 and/or use of a cooling fan in the projectile hopper 12.

| Projectile Hopper System | Design Balls Per Second | Play Enhancement System Projected Balls per Second % increase |
|---|---|---|
| ODYSSEY HALO Z with rip drive | 22 | 3–20% |
| ODYSSEY HALO TSA LED | 10–12 | 3–20% |
| ODYSSEY HALO A | 16 | 3–22% |
| VIEWLOADER EVLUTION Y Board | 16–17 | 2–15% |
| VIEWLOADER EVLUTION X Board | 18–20 | 2–22% |
| VIEWLOADER REVUTION X | 12 | 2–8% |
| VIEWLOADER QUANTUM | 8 | 2–14% |
| VIEWLOADER REVUTION | 8 | 2–15% |
| RICOCHET AK | 12 | 2–15% |
| EMPIRE RELOADER | 10–12 | 2–17% |
| AIR GUN DESIGNS WARP FEED | 22+ | 2–20% |

Figure 4:
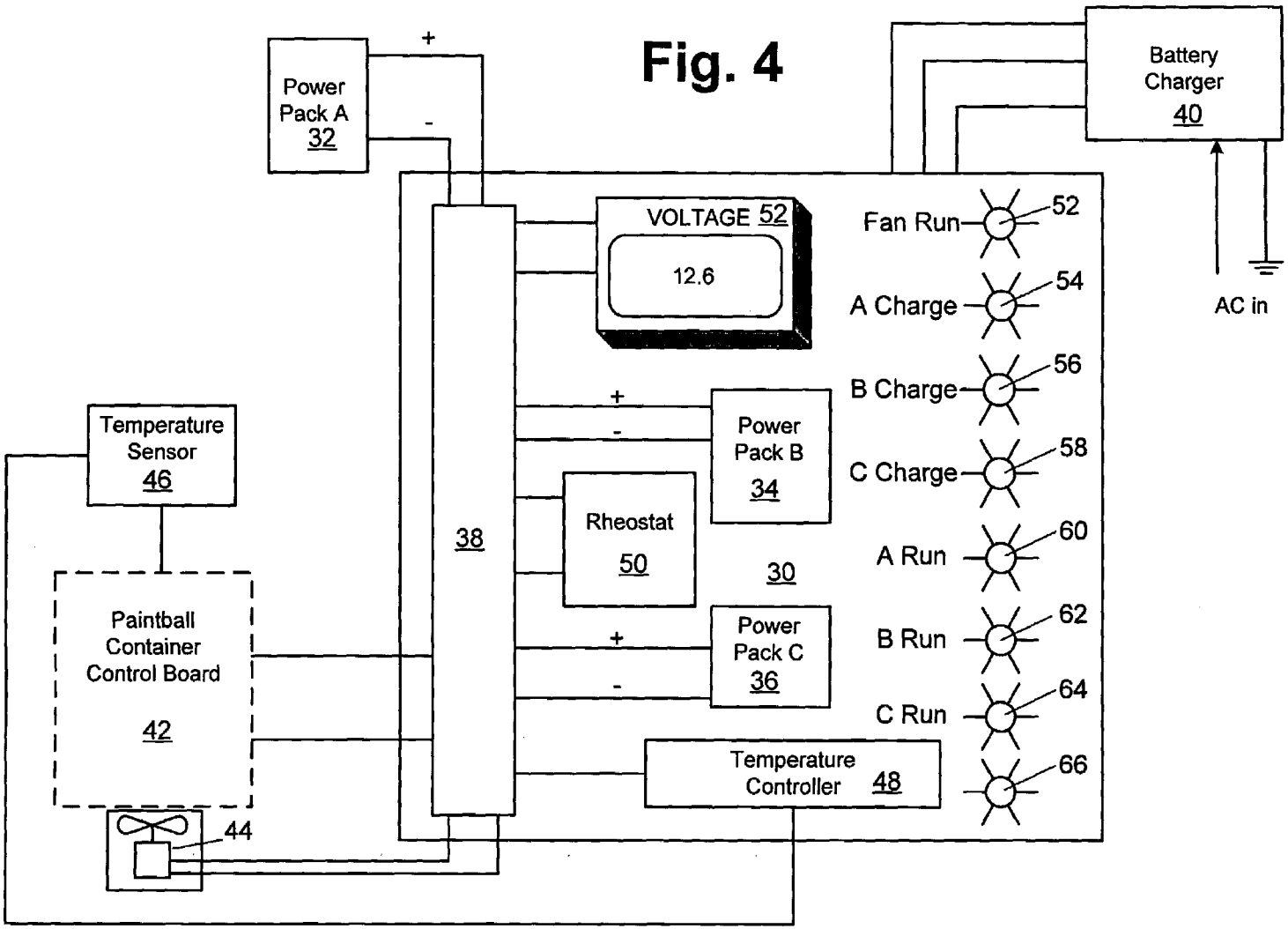
FIG. 4 is a schematic drawing of components of a play enhancement system according to the invention.

Details of the play enhancement system are illustrated with reference to FIGS. 4 and 5. In order to increase the voltage of the projectile hopper 12 feed system to increase the delivery speed of paintballs 14, it is preferred that a circuit board 42 in the projectile hopper 12 be modified to include a cooling fan 44. The cooling fan 44 may be run continuously when the third power source 36 is in use, or may be controlled to run intermittently as needed by use of a thermostat or other temperature sensing device 46 located adjacent the circuit board 42 in the projectile hopper 12. In the alternative, a programmable controller may be provided in the play enhancement system 30 to automatically control circuit board 42 cooling when a higher voltage or increased conveyor speed is selected by a user. Accordingly, a temperature control device 48 is included in the play enhancement system 30 to control the operation of the cooling fan 44.

As set forth above, the play enhancement system preferably includes a variable resistor or rheostat for controlling the voltage provided to the projectile hopper circuit board 42. The rheostat 50 may be manual or digitally controlled to provide the desired voltage boost to the circuit board 42. The voltage provided to the circuit board 42 is preferably indicated on a digital readout device 52 such as a liquid crystal display (LCD) on the play enhancement system 30. The LCD 52 preferably provides the current voltage provided from the play enhancement system 30 to the circuit board 42 for monitoring the voltage provided to the board 42. The LCD 52 may also provide current status of the system, including power source in use, power source being charged, and system faults.

Indicators lights 52–66 are also preferably provided to indicate the current status of the system for easy monitoring and selection of system parameters. The indicator lights 52–56 may be incandescent lights or preferably light emitting diodes (LED's).

Figure 5:
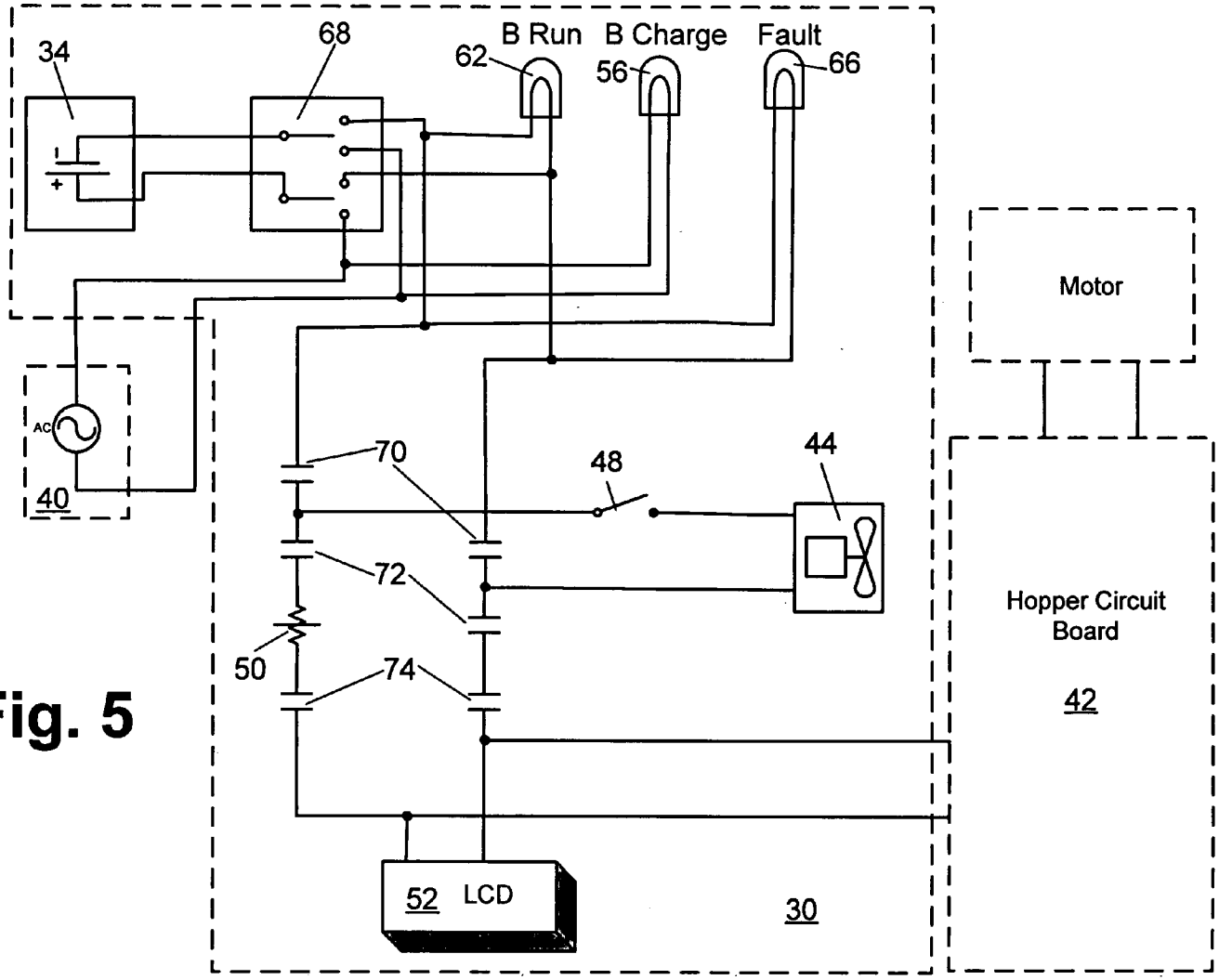
FIG. 5 is a partial schematic drawing of a representative power and control system for a play enhancement system according to the invention.

A representative circuit diagram of the play enhancement system is illustrated in FIG. 5. Only power source B 34 is illustrated in FIG. 5, however the circuit configuration is similar for power source A 32 and power source C 36. It will be appreciated that more than two or three power sources may also be used to further increase play time. In addition to the switch 68 for connecting the power source B 34 to either the charger 40 or the hopper circuit board 42, the system 30 also includes a relay or switch 70 for providing fault indication in the system via LED 66. A fan control switch 72 is provided for operation of the fan 44 in conjunction with the temperature control device 48. An LCD switch 74 is provided to switch the LCD display on and off.

While the foregoing illustrations of the embodiments of the invention contemplate add on features that are attached to or remote from the projectile hopper 12, the invention also contemplates complete replacement of the circuit board 42 in the projectile hopper with a circuit board adapted to contain the features and elements of the invention. In such circumstance, a connection or plug is provided on the projectile hopper 12 to connect additional power supplies to the hopper 12.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A play enhancement system for a pneumatic projectile launcher comprising:

a first power source selected from a non-rechargeable direct current power source and a rechargeable direct current power source and at least a second power source selected from a non-rechargeable direct current power source and a rechargeable direct current power source for selective connection to a circuit board in a projectile hopper for the projectile launcher, wherein at least one of the first and second power sources comprises a rechargeable power source; and a switching device connected to the first and second power sources, and to the circuit board for selectively connecting the first power source or second power source between a power source recharger and the circuit board.

2. The play enhancement system of claim 1, further comprising a cooling device for cooling the circuit board, the cooling device being selectively connected to the first power source or the second power source.

3. The play enhancement system of claim 2, further comprising a temperature sensor attached to the circuit board for detecting the temperature of the circuit board and for controlling the cooling device to maintain a preselected temperature of the circuit board during play.

4. The play enhancement system of claim 1, further comprising a third power source for selective connection in series with the first power source or the second power source.

5. The play enhancement system of claim 4, wherein the third power source is a rechargeable power source.

6. The play enhancement system of claim 1, wherein the first power source is a rechargeable power source.

7. The play enhancement system of claim 1, further comprising a display device for displaying an output voltage to the circuit board from the first power source or second power source.

8. The play enhancement system of claim 7, wherein the first and second power sources, display device and switching device are fixedly attached to the projectile hopper.

9. The play enhancement system of claim 7, wherein the first and second power sources, and switching device are electrically connected to the circuit board but are remote from the projectile hopper.

10. The play enhancement system of claim 1, further comprising a projectile delivery booster disposed between the projectile hopper and the projectile launcher, the projectile delivery booster comprising a housing containing a motorized projectile conveyor and a delivery tube connected between the projectile delivery booster and an entrance port on the projectile launcher.

11. The play enhancement system of claim 10, wherein the projectile delivery booster includes a fourth power source.

12. The play enhancement system of claim 10, wherein the projectile delivery booster is switchably connected to the first power source or the second power source.

13. The play enhancement system of claim 1, further comprising a voltage adjustment device for adjusting the voltage from the first and second power sources to the circuit board.

14. A paintball hopper comprising the play enhancement system of claim 1.

15. A pneumatic projectile launcher comprising the play enhancement system of claim 1.

16. A method for increasing play time and/or projectiles ejected per second comprising, providing a play enhancement system for a pneumatic projectile launcher, the play enhancement system including a first power source and second power source for selective connection to a circuit board in a projectile hopper for the projectile launcher, wherein at least one of the first and second power sources comprises a rechargeable power source; a recharger for recharging at least one of the first and second power sources, a display device for displaying an output voltage to the circuit board from the first power source or the second power source, and a switching device connected to the first power source, the second power source, the recharger and the circuit board for selectively connecting the first power source or second power source to the recharger and to the circuit board, selecting the first power source for initial play, and switching from the first power source to the second power source when the display device indicates the first power source has reached a predetermined output voltage.

17. The method of claim 16 wherein the switching device comprises a plurality of manual selection switches, and the method further comprises selecting one of the selection switches to switch between the first and second power supplies when the display device signifies the predetermined output voltage.

18. The method of claim 16, wherein the play enhancement system includes a third power source for selective connection in series with the first power source or the second power source, further comprising selectively connecting the third power source to the first power source or to the second power source to increase the output voltage to the circuit board.

19. The method of claim 18, wherein the play enhancement system includes a voltage adjustment device for adjusting the output voltage to the circuit board, further comprising increasing or decreasing the output voltage by manipulating the voltage adjustment device.

20. In a paintball launching system containing a motorized paintball hopper having an exit port, and a paintball launcher having an entry port for movement of paintballs from the hopper to the launcher, the improvement comprising:

play enhancement means for providing power to the motorized paintball hopper, the play enhancement means including at least a first power source selected from a non-rechargeable direct current power source and a rechargeable direct current power source, and at least a second power source selected from a non-rechargeable direct current power source and a rechargeable direct current power source, wherein at least one of the first and second power sources is a rechargeable power source, and control means connected to the first and second power sources and the motorized paintball hopper for switching between the first power source and the second power source.

21. The paintball launching system of claim 20, further comprising switching means connected to the first power source, to the second power sources, and to recharger means for selectively connecting the first power source or second power source to the motorized paintball hopper and to the recharger means.

* * * * *